US005715507A

United States Patent [19]

Kobayashi et al.

[11] Patent Number: 5,715,507

[45] Date of Patent: Feb. 3, 1998

[54] COLOR IMAGE FORMING PROCESS WITH CONTROL GLOSS

[75] Inventors: Yoshiaki Kobayashi; Meizo Shirose; Kazuya Isobe; Kaori Soeda; Yoshiki Nishimori; Hiroshi Yamazaki, all of Hachioji, Japan

[73] Assignee: Konica Corporation, Japan

[21] Appl. No.: 746,629

[22] Filed: Nov. 12, 1996

[30] Foreign Application Priority Data

Nov. 16, 1995 [JP] Japan ..... 7-298354
Nov. 28, 1995 [JP] Japan ..... 7-309186

[51] Int. Cl.[6] ..... G03G 15/01; G03G 13/01

[52] U.S. Cl. ..... 399/328; 430/99

[58] Field of Search ..... 399/321, 331, 399/333, 328; 430/99, 45, 124; 219/216, 419

[56] References Cited

U.S. PATENT DOCUMENTS 4,639,405 1/1987 Franke ..... 430/124
5,450,183 9/1995 O'Leary ..... 399/321
5,508,138 4/1996 Shimizu et al. ..... 430/99

FOREIGN PATENT DOCUMENTS 61-32081 2/1986 Japan .
92-336579 11/1992 Japan .

*Primary Examiner*—Arthur T. Grimley
*Assistant Examiner*—Quana Grainger
*Attorney, Agent, or Firm*—Jordan B. Bierman; Bierman, Muserlian and Lucas LLP

[57] ABSTRACT

An image forming process is disclosed, comprising the steps of passing an image recording material comprising a support having thereon an image formed of a toner containing a resin and a colorant, through a fixing member comprised of a pair of a heating roller and a pressure roller, and heat-fixing the image to the support by the fixing member, wherein the thus-formed image has a standard glossiness of 17 to 37.

5 Claims, 3 Drawing Sheets

COLOR IMAGE FORMING PROCESS WITH CONTROL GLOSS

FIELD OF THE INVENTION

The present invention relates to a process for forming a color image, an image forming apparatus, and particularly to a faithful reproduction of a color image.

BACKGROUND OF THE INVENTION

There have been various processes of forming a color image on an image supporting member including, for example, a printing process, an ink-jet process, a thermal transfer process and an electrophotographic process. Images formed in the processes have had various characteristics of hues, surface conditions and so on. About hues, there have been numerous studies heretofore. For the purposes of making a color reproduction range wider and a chroma higher, there have been numerous reports on the structures and dispersibility of colorants and so on. On the surface conditions of an image, however, the texture and depth of the image have been varied according to the surface conditions. In particular, the surface conditions have seriously influenced the reproduction of the reality of a graphic image. In an image forming process applied with an electrophotographic system, the image types have been heretofore classified only by a glossy image having a high surface smoothness and a mat image having a low surface smoothness and, therefore, any proper surface condition capable of reproducing the reality of an actual image has not been realized so far.

SUMMARY OF THE INVENTION

In consideration of the problems as described above, the present invention is directed to an image capable of expressing the image reality with high texture and depth, and an image forming process and apparatus therefor.

The invention can be achieved in the following means.

(1) An image forming process comprising passing an image recording material comprising a support having thereon an image comprised of colored particles (toner particles) each comprising at least a resin and a colorant through an interface between a movable fixing member and a rotatable pressure member brought into pressure contact with the fixing member, and heat-fixing the colored particles to the support, by a fixedly arranged heating member, through the fixing member to form the image, wherein a standard glossiness of the image formed is within the range of 17 to 37.

(2) An image forming process comprising:

passing an image recording material comprising a support having thereon an image formed of at least a toner containing a resin and a colorant through a fixing member comprising a pair of a heating roller and a pressure roller, and heat-fixing the image to the support by the fixing member provided with a heater, wherein a standard glossiness of the image is within a range of 17 to 37.

(3) The image forming process as described in (1) or (2), wherein said toner meets the following requirement:

$$A \times Ra + 2.11 < \log G' < B \times Ra + 4.13$$

wherein G' represents an elastic modulus, Ra represents a surface roughness of the heating roller, and A and B is −0.0109 and −0.0526, respectively.

(4) The image forming process as described in (1) to (3), wherein said image is a color image comprised of a yellow toner, magenta toner, cyan toner or black toner.

(5) An apparatus for forming an image by the process as described in (1) to (4).

DETAILED DESCRIPTION OF THE INVENTION

Figure 1:
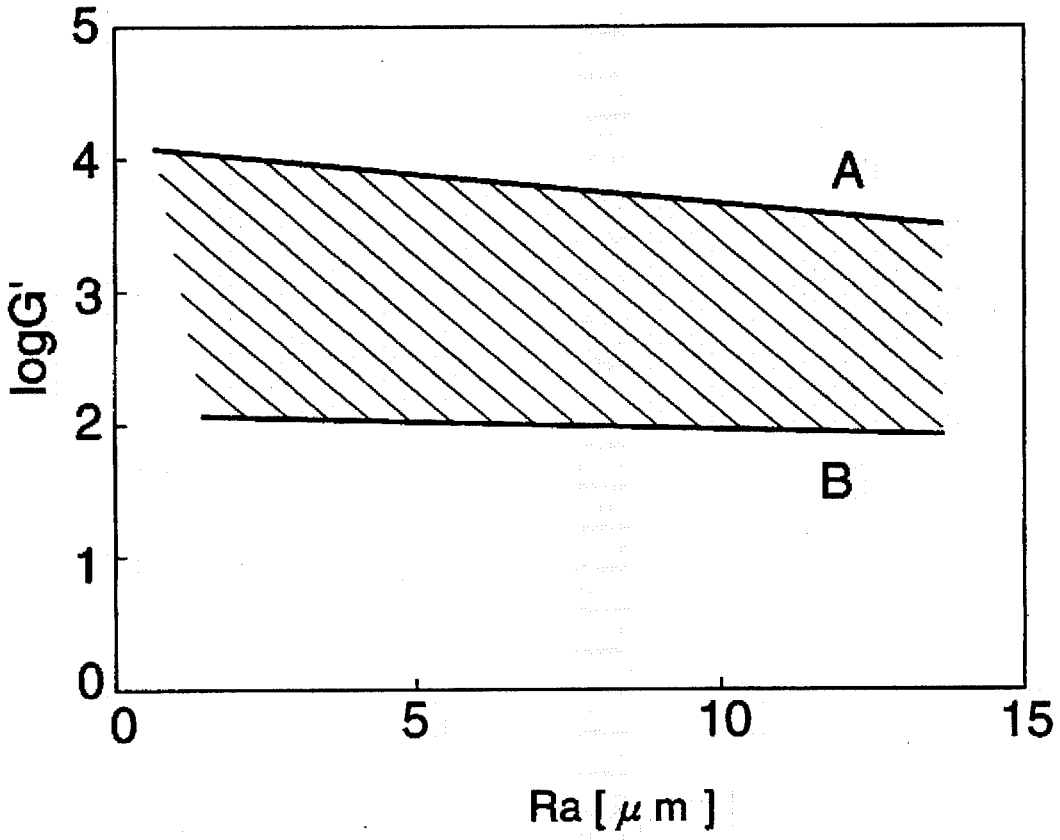
FIG. 1 illustrates a range of a standard glossiness related with a elastic modulus of a toner and a surface roughness of a heating roller.

In the invention, the standard glossiness is referred to as specular glossiness, which is expressed by a value obtained in such a manner that an image-formed portion on an image supporting member covered 90% or more by an image forming material is measured at an incident angle of 75' by means of a gloss meter Model VGS-1D (manufactured by Nippon Denshoku Kogyo K.K.), according to the Method 2 specified in JIS-Z8741 (1983), in which the word, "JIS" is referred to as Japanese Industrial Standard. The coverage ratio of the image forming material on an image supporting member was measured by a high-speed color image analyzer Model SPICCA (manufactured by Japan. Avionics Co.).

The standard glossiness relating to the invention is to be within the range of 17 to 37 and, preferably, 17 to 27. When the standard glossiness is within these range, the image has vividness to obtain satisfactory texture and reality. Further, when the surface is smooth, the quantity of incident light to the inside increases to be liable to deteriorate a colorant, resulting in aging deterioration of an image. For preventing deterioration of the colorant, it is particularly preferable that the standard glossiness is to be not more than 27.

There are various controls of surface smoothness, including, for example, the control of the surface conditions of an image supporting member.

For instance, in an electrophotographic type image forming process which uses a heated roller in the fixing step, although it is easy to control the surface smoothness of the image supporting member, it is difficult to balance the fixability and the gloss property and to obtain stable control of the glossiness while controlling the surface smoothness or the melt point of the toner used as an image forming material. Stable glossiness may be hard to obtain, particularly when the fixing temperature varies due to the environmental conditions. It is, therefore, preferable to use a process for controlling the surface roughness of the heating roller, (the measurement of the surface roughness is made by a surface roughness meter which is called a Surftest 402, Series 178, manufactured by Mitsutomi Co. Ltd.). When a surface roughness is within the range of Ra=2.0 μm to 10 μm, it is suitable to obtain an image having a standard glossiness within the range of 17 to 37.

Generally, the heating roller fixing is carried out in such a manner that at least one of two rollers is heated and pressure is applied to the interface between the two rollers and then that the heated roller (that is a fixing roller) is so set as to face to the image forming side Of a support and the support provided thereon with an image forming material is fed to the interface between the rollers. Therefore, the surface roughness of the heating roller means that of a roller in contact with the image forming material.

The above-mentioned surface roughness can be controlled by providing the fixing roller surface brought into contact with an image with unevenness. To be more concrete, it can be controlled in such a manner that unevenness is formed on the surface of the core bar constituting the fixing roller by applying a sandblast, scratches or the like thereto and then a layer comprising a releasable resin such as a fluorocarbon resin and fluorocarbon rubber is formed on the surface of the core bar, or in such a manner that a blast is applied to the surface of the releasable coated layer of a fixing roller itself. Alternatively, it is possible to form unevenness by interposing fine particles between the core bar of the fixing roller and a releasable coated layer.

Now, the process and apparatus each for forming the above-mentioned image will be detailed by showing the following exemplary examples. However, the invention shall not be limited thereto.

Image Forming Process

The image forming processes applicable to the invention include any one of the following processes; namely, a process in which an image is formed in such a manner that a solvent containing a pigment or a dyestuff is transferred to an image forming member by applying pressure; another process in which a resin containing a pigment or a dyestuff is thermally transferred; and a further process in which a resin containing a pigment or a dyestuff is electrostatically transferred and the transferred resin is then fixed to an image supporting member by making use of a heating roller. Among the processes, it is particularly preferred, from the point of view of the controllability of the image surface conditions, to use the process in which a resin containing a pigment or a dyestuff is electrostatically transferred and the transferred resin is then fixed to an image supporting member by making use of a heating roller.

Image Forming Material

A variety of image forming materials may be used so as to meet an image forming process. From the point of view of an image surface condition controllability and a color reproducibility, it is particularly preferred to use a two-component type developer comprising non-magnetic toner and magnetic carrier.

As for the above-mentioned carriers, any one of carriers including resin particles containing iron powder, ferrite, magnetite or a magnetic material and those resin-coated on the above-given materials. From the point of view of the stable charge controllability, resin-coated ferrite or magnetite is preferred. As a carrier core (magnetic particle), it is preferable to use magnetic particles having a specific gravity of 3 to 7 and a weight average particle size of 30 to 65 μm. The weight average particle size as mentioned above can be determined by Microtrack SRA MK-II (manufactured by Nikkiso Co., Ltd.), for example.

As for the coating resins, it is allowed to use fine particles comprising such a resin as a styrene type resin, an acryl type resin or a styrene-acryl type resin. From the viewpoints of durability and developability, the resin coating. layer is preferably to be coated so as to have an average coating layer thickness of 1.0 to 5.0 μm. The average coating layer thickness is calculated out in such a manner that a carrier core is assumed to have a perfect sphericity based on its weight average particle size measured by the above-mentioned Microtrack SRA MK-II, and that the volume of the core is calculated out of the weight found out according to the specific gravities of the carrier core and the coating material.

Surface smoothness of the image can be controlled in various manners, according to image forming processes. Particularly, it is preferred to control an elastic modulus of the toner (G') and surface roughness of a heating roller (Ra). For obtaining an image having a standard glossiness of 17 to 37, it is preferable that the relation between the above two factors is to be within the range satisfying the following relational expression:

$$A \times Ra + 2.11 < \log G' < B \times Ra + 4.13$$

wherein A and B are respectively −0.0109 and −0.0526.

The relation between a heating roller surface roughness Ra (in μm) and a toner elasticity G' will be detailed with reference to FIG. 1. In the Figure, when plotting an elasticity G' as an ordinate and a heating roller surface roughness Ra as an abscissa, an image is obtained by making use of the combination of a toner having different elasticity G' and a heating roller having a different surface roughness Ra. As the result of measuring the standard glossiness of the resulting image, when being positioned between the resulting lines A and B, the standard glossiness is within the range of 17 to 37. An image having a good texture and a satisfactory depth can be obtained so that the resulting image can be reproduced with reality. If the point is positioned lower than line B, the standard glossiness becomes lower than 17. If the point is positioned upper than line A, the standard glossiness becomes higher than 37. Therefore, the resulting texture and depth are deteriorated so that the reproduction of a graphic image and the like may not be suitable.

Any commonly-used toners may be used as a toner satisfying the above-given relational expression. The toner control can be achieved by optimizing the kinds and molecular weights of a resin constituting the subject toner and the high polymer content ratios when the resin comprises plural high polymers, each having different molecular weights. With respect to preferred molecular weight distribution determined in the GPC chromato graph of THF-soluble component, for example, a area ratio of a lower molecular weight component with molecular weights of 1,500 to 80,000 (SLp) to a higher weight component with molecular weights of 80,000 to 1,000,000 (SHp) is preferably 2 to 20.

To be more concrete, it is preferable to use a toner in which fine inorganic particles are added as an external agent and which achieves improvements in fluidity and cleaning property. Any generally applicable binders may be used as a binder resin for toner use. Among them, a polyester resin and a styrene-acryl resin which are excellent in fixing characteristics may preferably be used. Besides the above, a releasing agent or the like may also be added, provided that the above-mentioned surface condition controls shall not be affected.

As for the fine inorganic particles applicable to the invention, those having a number average primary particle size of 10 to 500 nm may preferably be used. The number average primary particle size as mentioned above is observed through a transmission type electron microscopy and then measured in an image analysis. As for the materials constituting inorganic fine particles, various kinds of inorganic oxides, nitrides, borides and so forth may preferably be used. For example, they include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride and boron nitride. Further, those prepared by subjecting the inorganic fine particles to hydrophobicity-providing treatment may also be used. The hydrophobicity-providing treatment, is made preferably using so-called coupling agent such as a variety of titanium coupling agents and silane coupling agents. Still further, it is also preferable to carry out the hydrophobicity-providing treatment with such a higher fatty acid metal salt as aluminum stearate, zinc stearate and calcium stearate.

In the invention, the elastic modulus of the toner (G') can be measured by making use of a viscoelastic meter Model MR-500 (manufactured by Rheology Co., Ltd.) and a 10Ø parallel plate as a jig and then by setting an applied frequency at 1 Hz and a distortion angle to be automatically controlled. The result of the measurement can be obtained as a value (° C.) of a fixing temperature minus −20° C. when carrying out the temperature dependency of a viscoelasticity in the course of a temperature raising step. The word, "fixing temperature" means a surface temperature of a roller with a built-in heater at the time of starting the fixation, and it is measured on the side opposite to the fixing section, through a contact type thermometer.

Image Forming Process

The image forming processes applicable to the invention include any one of the following processes; namely, a process in which an image is formed in such a manner that a solvent containing a pigment or a dyestuff is transferred to an image forming member by applying pressure; another process in which a resin containing a pigment or a dyestuff is thermally transferred; and a further process in which a resin containing a pigment or a dyestuff is electrostatically transferred and the transferred resin is then fixed to an image supporting member by making use of a heating roller. Among the processes, it is particularly preferred, from the point of view of the controllability of the image surface conditions, to use the process in which a resin containing a pigment or a dyestuff is electrostatically transferred and the transferred resin is then fixed to an image supporting member by making use of a heating roller, that is, heating roller fixing process.

In the heating roller fixing, at least one of two rollers which are applied by pressure is heated and a image forming material is passed through between the two rollers so as to bring the heated roller into contact with the image forming side of the image forming material. Accordingly, the surface roughness of the roller is referred to as that of the roller in contact with the image forming material. Details of the definition and designation of the surface roughness are referred to JIS B0601-1994.

The surface roughness of the heating roller, Ra (μ m) can be measured by a surface roughness tester, Surftest 402 Series 178 (product by Mitsutoyo Co. Ltd.). The measurement of the surface roughness is also referred to JIS B0651-1996. Controls of the surface roughness can be made by forming irregularity on the surface of the roller with such a sandblast treatment. Concretely, a method is that the surface of metal core portion consituting the fixing roller is subjected to such a sandblast treatment to form irregularity on the surface thereof and further thereon is formed a resin layer with a resin having releasing property, such as fluororesin or fluororubber. Another method is that a covering layer surface of the fixing roller is subjected to the sandblast treatment. Further alternative method is that fine particles are made present between the metal core and the covering layer to form irregularity on the surface.

Image Forming Apparatus

As an image forming apparatus applicable to the invention, any common printing machines, copiers or printers may be optionally employed so as to meet an image forming process. As one of the examples thereof, an electrophotographic type image forming apparatus will be explained (FIG. 2).

Figure 2:
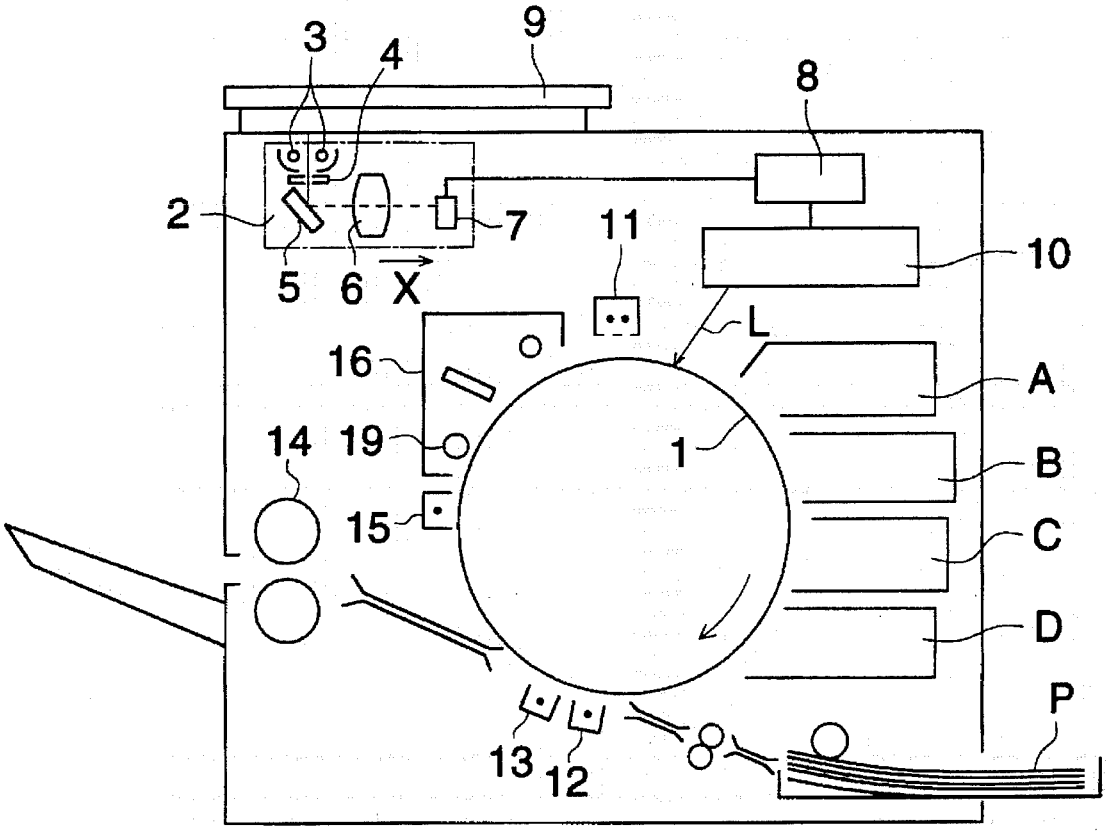
FIG. 2 is a schematic sectional view of an image forming apparatus of the invention.

In FIG. 2, 1 is an image forming member comprising a negatively chargeable OPC photoreceptive member having a carrier transport layer as the upper layer thereof and it is rotatable in the direction of the arrow mark. 2 is an image input section comprising illumination light source 3, color-separation filter 4 comprising, for example, a series of blue., green, red and ND filters interchangeable each other, reflection mirror 5, lens 6 and one dimensional CCD image sensor 7. 8 is an image processing section including an inverter capable of converting a color-separation information into a complementary color information. 9 is a multicolored original document. L is a laser beam emitted from laser optical system 10. 11 is a negatively charging electrifier comprising a pair of scorotron charging electrodes. 12 is a corona discharger for image transfer. 13 is a separation electrode. 14 is a fixer. 15 is a precleaning electric neutralizer. And, 16 is a cleaning device. A, B, C and D are developing units containing yellow, magenta, cyan and black developers, respectively.

Reflection light inputted from image input section 2 is color-separated through color-separation filter 4. The resulting color-separation information is read by CCD image sensor 7 and, is then converted into electric signals. The electric signals are then converted into the corresponding data at image processing section 8 so as to be suitable for recording. In the first rotation of image forming member 1, laser beam L is applied, based on the resulting image data and, for example, based on the recording data of the yellow component, from laser optical system 10 to image forming member 1 uniformly negative-charged by electrifier 11 for negatively charging the surface of the image forming member, so that an electrostatic latent image corresponding to the recording data can be formed on image forming member 1.

The resulting electrostatic latent image is developed in development unit A containing yellow toner. In the same manner, the magenta, cyan and black toner images are superposed one after another, so that a color toner image consisting of four basic colors can be formed. The resulting color toner image is collectively transferred to image supporting member P by corona discharge electrode 12 for transferring the image. Then, the image supporting member is separated from the image forming member by separation electrode 13 and is then fixed in fixing unit 14, so that a color image can be formed.

On the other hand, after the color toner image is transferred, image forming member 1 is electrically neutralized by precleaning neutralizer 15 and is then cleaned by cleaning device 16 so as to be ready to form the next color image.

Figure 3:
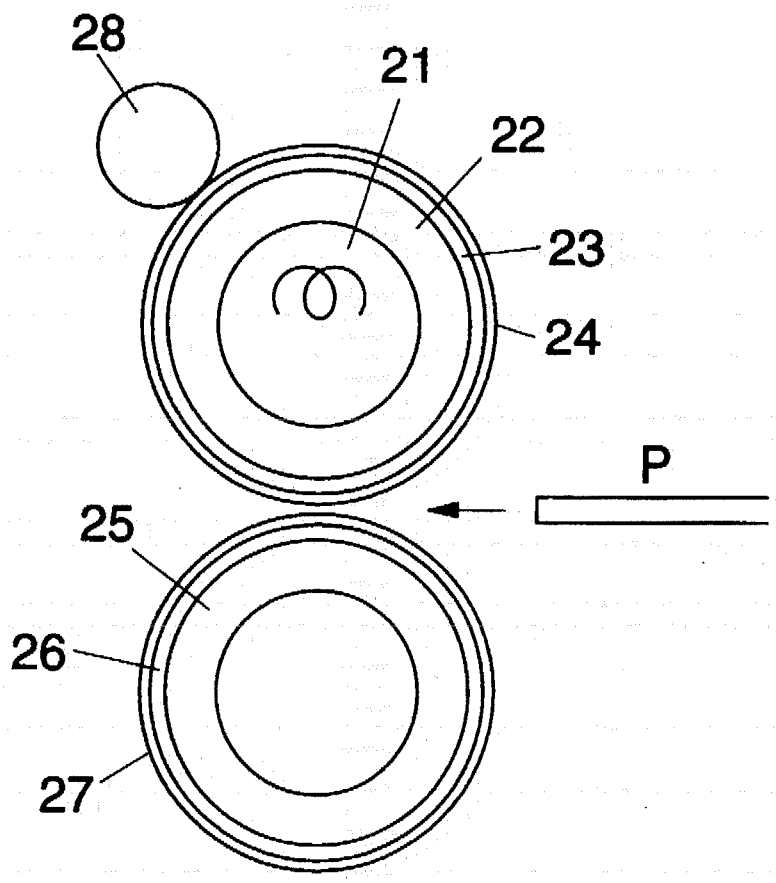
FIG. 3 is a schematic sectional view of a fixing member of the invention.

Now, one embodiment of the structure of a fixing unit preferably used for the invention is shown in FIG. 3.

A fixing unit applicable to the invention comprises the upper and lower rollers. The upper roller comprises a metal (e.g., iron or aluminum) cylinder with built-in heat source. The cylinder is covered by a tube comprising thereon a releasable resin coated layer made of, for example, tetrafluoroethylene or a polytetrafluoroethylene-perfluoroalkoxy vinylether copolymer, or by a tube made of LTV silicone rubber comprising thereon a releasable resin coated layer made of, for example, tetrafluoroethylene or a polytetrafluoroethylene-perfluoroalkoxy vinylether copolymer. The lower roller comprises silicone rubber or the like. To be more detailed, the fixing unit has a linear heater as the heat source and the surface of the upper roller is heated within the range of approximately 120° to 200° C. In the fixing section, the lower roller is deformed by applying pressure to the interface between the upper roller and the lower roller so as to form the so-called nip. A nip width is to be within the range of 1 to 10 mm and, preferably, 5 to 7 mm. A fixing linear velocity is preferably within the range of 40 mm/sec. to 400 mm/sec.

Pressure to be applied to the interface between the fixing rollers is preferably within the range of 1.0 to 5.0 kgf/cm$^2$. If a nip is relatively narrower, heat is difficult to be uniformly applied to toners, so that a fixing unevenness may be produced. On the other hand, if a nip width is relatively wider, a resin is accelerated to be fused, so that the problem of too much fixing offset may be produced. Further, a cleaning mechanism may also be attached to the above-mentioned fixing unit. To be more concrete, a pad or roller comprising unwoven cloth impregnated with silicone oil may be used for.

In FIG. 3, 21 is a 600 W halogen heater lamp (built it in the center of the roller on the image forming side). 22 is a 40 mmØ hollow aluminum roller and, on the surface of the roller, 1 mm-thick LTV silicon rubber layer 23 having a rubber hardness of 90° obtained through an Askar C hardness meter and 50 μm-thick PFA tube layer 24 are so formed as to constitute a fixing roller. On the other hand, the pressure roller on the non-image forming side is comprised of 40 mmØ hollow aluminum roller 25 and the surface thereof has 3 mm-thick LTV silicon rubber layer 26 and 50 μm-thick PFA tube layer 27.

In the fixing unit, the pressure-contact nip load applied. to the both rollers is 2.5 kgf/cm$^2$. In the same FIG., 28 is a cleaning roller.

EXAMPLES

Example 1

Preparation of a Black Toner

One hundred (100) parts of polyester having a softening point of 115° C., 10 parts of carbon black and 3 parts of polypropylene were mixed up together, kneaded, pulverized and then classified, so that colored particles having a volume-averaged particle size of 8.5 μm were prepared. Further, 0.7 parts of silica fine particles (having a particle size of 12 nm), which were surface-treated with a silane coupling agent, were added to 100 parts of the resulting colored particles and they were mixed together by a Henschel mixer, so that black toner having an average particle size of 8.5 μm was prepared. As for the volume-averaged particle size of the resulting toner, the volume-average particle size measured through a Coulter Counter Model TA-11 (manufactured by Coulter Co.) was employed.

The particle sizes of the fine inorganic particles were those calculated out of the specific surface area (in m$^2$/g) obtained in a BET method, presuming that the particles were perfectly spherical and had one and single particle size. The softening point of the resin was measured through a flow tester, Model CFT-500 (manufactured by Shimazu Mfg. Co., Ltd.).

Preparation of Color Toner

In the above-mentioned example of the black toner preparation, the following colorant were used in place of carbon black, so that the yellow, magenta and cyan colored particles having the average particles sizes of 8.4, 8.6 and 8.5 μm were each prepared. Next, 0.7 parts of silica fine particles (having a particle size of 12 nm), which were surface-treated with silane coupling agent, were added to 100 parts each of the resulting colored particles, respectively, and then mixed up by a Henschel mixer, so that yellow, magenta and cyan toners were prepared, respectively.

Yellow colorant: C.I. Pig. Yellow 17 8 parts

Magenta colorant: C.I. Pig. Red 122 8 parts

Cyan colorant : C.I. Pig. Blue 15:3 4 parts

Preparation of Carrier

In a spray-dry process, using 40 g of styrene/methyl methacrylate=6/4 copolymer fine particles were covered 1960 g of Cu—Zn ferrite particles with a specific gravity of 5.0, weight average particle size of 50 μm and a saturation magnetization of 25 emu/g obtained when applying an external magnetic field of 1000 Oe, so that carrier particles were prepared.

Preparation of Developer

The resulting carrier and toner were mixed up for 20 minutes by a YGG mixer so as to have a toner density of 7% by weight.

Preparation of Sample Image

By making use of the above-mentioned image forming apparatus and developer and a high definition color digital standard image (SCID: Standard Color Image Data) of a bicycle as the original document image, a sample image was prepared.

Examples of Sample

The fixing conditions were as stated hereunder. The apparatus shown in FIG. 3 was used, wherein 21 was a 200 W halogen heater lamp (built it in the center of the roller on the image forming side); and 22 was a 40 mmØ hollow aluminum roller and, on the surface of the roller, 1 mm-thick LTV silicon rubber layer 23 having a rubber hardness of 90° obtained through an Askar C hardness meter and 50 μm-thick PFA tube layer 24 were so formed as to constitute a fixing roller.

On the other hand, the pressure roller on the non-image forming side was comprised of 40 mmØ hollow aluminum roller 25 and the surface thereof was coated by 3 mmØ-thick LT V silicon rubber layer 26 and 50 μm-thick PFA tube layer 27. In the fixing unit, the pressure-contact nip load applied to the both rollers was 2.5 kgf/cm$^2$. In the Figure, 28 was a cleaning roller comprising an unwoven cloth impregnated with dimethyl silicone oil.

The above-mentioned fixing unit was used and the surface thereof was scratched, so that a fixing unit having the following surface roughness could be used in the example.

The resulting image was evaluated in the following manner. In a solid image patch portion of the resulting image, the standard glossiness was measured and, further, the texture, depth and expression of the reality were subjectively evaluated. The subjective evaluation was carried out in accordance with a scale assessment technique. The category of the evaluation was classified into 5 grades (Bad, Poor, Fair, Good and Excellent). Each of the evaluators evaluated twice independently on the resulting image and the average grade of all the evaluators' evaluation was regarded as the evaluation result. After the sample images were formed and were then acceleratingly aged by an exposure tester, they were also evaluated. The exposure tests were carried out for 7 days through a Fade-O-Meter (with a xenon lamp having 70000 lux at 44° C.).

1 point (Bad): No texture and depth, nor reality
2 points (Poor): Insufficient in texture, depth and reality
3 points (Fair): Slightly insufficient in texture, depth and reality
4 points (Good): Texture, depth and reality found
5 points (Excellent) : Texture, depth and reality satisfactorily reproduced As the evaluators, 50 people were selected out at random. When making the evaluation, the visual evaluation distance was set to be 300 to 400 mm and the illuminance was set to be 1000±50 lux. When a subject image was evaluated to be not lower than 4.0, it was qualified as an image having satisfactory texture, depth and reality, so that it was regarded as a practically excellent image. The results of the evaluation will be shown in Table 1 given hereunder.

TABLE 1

| Fixing unit No. | Surface roughness | Std. glossiness | Evaluation point Before exp. test | Evaluation point After exp. test | Remarks |
|---|---|---|---|---|---|
| 1 | 2.0 | 30 | 4.6 | 4.1 | Invention |
| 2 | 3.5 | 27 | 4.7 | 4.6 | Invention |
| 3 | 9.0 | 17 | 4.6 | 4.5 | Invention |
| 4 | Not surface-treated | 40 | 3.5 | 2.7 | Comparison |
| 5 | 10.5 | 12 | 3.0 | 3.0 | Comparison |

From the results shown in Table 1, the images relating to the invention were so high as not lower than 80% of the evaluation points, so that they were practically excellent images.

Example 2

Preparation of Toner

Styrene-acryl resin, colorant and polypropylene were mixed up, headed, pulverized and classified, so that colored particles having a volumetric average particle size of 8.5 μm were prepared. Further, to 100 parts of the resulting colored particles, 0.7 parts of silica fine particles (having a particle size of 12 nm) surface-treated with silane coupling agent and they were mixed up by a Henschel mixer, so that black toner having an average particle size of 8.5 μm was prepared. A volume-averaged particle size of the resulting toner and the particle sizes of the inorganic fine particles were determined in the same manner as in Example 1. The softening point of the styrene-acryl resin was measured through a Flow Tester Model CFT-500 (manufactured by Shimazu Mfg. Co., Ltd.).

In the styrene-acryl resin, resins comprising a low molecular weight component and a high molecular weight component each having different molecular weights and contents were selectively used, so that the following toners each having different elasticities were prepared. The respective compounding ratios of the toners will be shown in the following Table 1. In the table, the compounding ratios of the colorants applied to 100 parts of the resins and 3 parts of the low molecular weight polypropylene are shown.

TABLE 2

| Developer | Toner No. | Colorant | | logG' |
|---|---|---|---|---|
| 1 | Black toner 1 | Carbon black | 10 parts | 1.90 |
| | Yellow toner 1 | C.I. Pig. Yellow 17 | 8 parts | 1.95 |
| | Magenta toner 1 | C.I. Pig. Red 122 | 8 parts | 1.95 |
| | Cyan toner 1 | C.I. Pig. Blue 15:3 | 4 parts | 1.89 |
| 2 | Black toner 2 | Carbon black | 10 parts | 2.44 |
| | Yellow toner 2 | C.I. Pig. Yellow 17 | 8 parts | 2.52 |
| | Magenta toner 2 | C.I. Pig. Red 122 | 8 parts | 2.29 |
| | Cyan toner 2 | C.I. Pig. Blue 15:3 | 4 parts | 2.71 |
| 3 | Black toner 3 | Carbon black | 10 parts | 3.64 |
| | Yellow toner 3 | C.I. Pig. Yellow 17 | 8 parts | 3.60 |
| | Magenta toner 3 | C.I. Pig. Red 122 | 8 parts | 3.59 |
| | Cyan toner 3 | C.I. Pig. Blue 15:3 | 4 parts | 3.57 |
| 4 | Black toner 4 | Carbon black | 10 parts | 3.98 |
| | Yellow toner 4 | C.I. Pig. Yellow 17 | 8 parts | 4.05 |
| | Magenta toner 4 | C.I. Pig. Red 122 | 8 parts | 4.10 |
| | Cyan toner 4 | C.I. Pig. Blue 15:3 | 4 parts | 4.08 |

Preparation of Carrier

In a spray-dry process, using 40 g of styrene/methyl methacrylate (6/4) copolymer fine particles were covered 1960 g of Cu—Zn ferrite particles having a specific gravity of 5.0, weight average particle size of 50 μm and a saturation magnetization of 25 emu/g obtained when applying an external magnetic field of 1000 Oe, so that carrier particles were prepared.

Preparation of Developer

The resulting carrier and toner were mixed up for 20 minutes by a YGG mixer so as to have a toner density 7% by weight.

Preparation of Sample Image

By making use of the resulting developer, the evaluation was made under the following fixing conditions.

As for the evaluation apparatus, the image forming apparatus having the structure shown in FIG. 2, Model 9028 (manufactured by Konica Corp.) was modified as follows. In the heating roller type fixing unit thereof having the same specifications as shown in FIG. 3, the heating roller was scratched to have the following surface roughness Ra and it was built in the evaluation apparatus.

By making use of a high definition color digital standard image (SCID: Standard Color Image Data) of a bicycle as the original image, a sample image was prepared.

| Fixing unit No. | Surface roughness Ra of heating roller |
|---|---|
| Unit 1 | 0.3 |
| Unit 2 | 3.7 |
| Unit 3 | 8.3 |
| Unit 4 | 12.1 |

Evaluation

The resulting image was evaluated in a manner similar to Example 1. Results thereof are summarized in Table 3.

TABLE 3

| Developer | Fixing Unit. No | Std. glossiness | Evaluation point Before exp. test | Evaluation point After exp. test | Remarks |
|---|---|---|---|---|---|
| Developer 1 | Unit 4 | 36 | 4.4 | 4.0 | Inv. |
| Developer 2 | Unit 1 | 35 | 4.4 | 4.0 | Inv. |
| Developer 2 | Unit 2 | 31 | 4.5 | 4.2 | Inv. |
| Developer 2 | Unit 3 | 27 | 4.6 | 4.5 | Inv. |
| Developer 2 | Unit 4 | 22 | 4.7 | 4.7 | Inv. |
| Developer 3 | Unit 1 | 32 | 4.5 | 4.2 | Inv. |
| Developer 3 | Unit 2 | 28 | 4.5 | 4.4 | Inv. |

TABLE 3-continued

| Developer | Fixing Unit. No | Std. glossiness | Evaluation point Before exp. test | After exp. test | Remarks |
|---|---|---|---|---|---|
| Developer 3 | Unit 3 | 22 | 4.5 | 4.5 | Inv. |
| Developer 4 | Unit 1 | 17 | 4.4 | 4.4 | Inv. |
| Developer 1 | Unit 1 | 50 | 3.5 | 2.5 | Comp. |
| Developer 1 | Unit 2 | 44 | 3.5 | 2.9 | Comp. |
| Developer 1 | Unit 3 | 42 | 3.6 | 3.0 | Comp. |
| Developer 4 | Unit 2 | 11 | 3.0 | 3.0 | Comp. |
| Developer 4 | Unit 3 | 5 | 2.1 | 2.1 | Comp. |
| Developer 4 | Unit 4 | 2 | 2.1 | 2.1 | Comp. |

As is obvious from the contents of Table 2, when making use of a toner of which the relation between toner elasticity G' and heating roller surface roughness Ra can satisfy the requirements of the invention, the standard glossiness of an image can be controlled within the range of 17 to 37. Resultingly, a practically excellent image can be obtained so as to have the image texture, depth and reality.

What is claimed is:

1. An image forming process comprising:

passing an image recording material comprising a support having thereon an image comprising a toner containing a resin and a colorant through a fixing member comprising a pair of a heating roller and a pressure roller, wherein said toner meets the following requirement:

$$A \times Ra + 2.11 < \log G' < B \times Ra + 4.13$$

wherein G' represents an elastic modulus, Ra represents a surface roughness of the heating roller and wherein said surface roughness of the heating roller is 2 to 10 μm, and A and B are −0.0109 and −0.0526, respectively; and heat-fixing the image to the support by the fixing member, wherein a standard glossiness of the heat-fixed image is within a range of 17 to 37.

2. The image forming process of claim 1, wherein said image comprises a yellow toner, magenta toner, cyan toner or black toner.

3. The image forming process of claim 1, wherein said standard glossiness is within a range of 17 to 27.

4. The image forming process of claim 2, wherein at least one of the yellow toner, magenta toner, cyan toner and black toner meets the requirement $$A \times Ra + 2.11 < \log G' < B \times Ra + 4.13$$

wherein G' represents an elastic modulus, Ra represents a surface roughness of the heating roller, and A and B is −0.0209 and −0.0526, respectively.

5. The image forming process of claim 4, wherein each of the yellow toner, magenta toner, cyan toner and black toner meets the requirement $$A \times Ra + 2.11 < \log G' < B \times Ra + 4.13$$

wherein G' represents an elastic modulus, Ra represents a surface roughness of the heating roller, and A and B is −0.0109 and −0.0526, respectively.

* * * * *